United States Patent [19]

Poldervaart et al.

[11] Patent Number: 4,825,797

[45] Date of Patent: May 2, 1989

[54] MOORING DEVICE

[75] Inventors: Leendert Poldervaart; Willem C. De Boom, both of La Turbie, France

[73] Assignee: Single Buoy Moorings Inc., Marly, Switzerland

[21] Appl. No.: 181,087

[22] Filed: Apr. 14, 1988

[30] Foreign Application Priority Data

Apr. 16, 1987 [NL] Netherlands ..... 8700920

[51] Int. Cl.[4] ..... B63B 21/00

[52] U.S. Cl. ..... 114/230; 441/3

[58] Field of Search ..... 441/3–5; 114/230, 293

[56] References Cited

U.S. PATENT DOCUMENTS

| | | | |
|---|---|---|---|
| 4,530,302 | 7/1985 | Pedersen | 114/230 |
| 4,606,294 | 8/1986 | Tella et al. | 114/230 |

FOREIGN PATENT DOCUMENTS

| | | | |
|---|---|---|---|
| 2420475 | 10/1979 | European Pat. Off. . | |
| 0188840 | 7/1986 | European Pat. Off. . | |
| 100084 | 8/1979 | Japan | 114/230 |
| 155089 | 7/1986 | Japan | 441/3 |
| 8603241 | 4/1987 | Netherlands | 114/230 |
| 2019800 | 2/1983 | United Kingdom . | |

*Primary Examiner*—Sherman D. Basinger
*Assistant Examiner*—Stephen P. Avila
*Attorney, Agent, or Firm*—Young & Thompson

[57] ABSTRACT

Mooring device comprising a ship (9), an anchor (2), an arm (5,19) connected pivotably, directly or indirectly at one end with the anchor and at the other end with a weight swivellably suspended from the ship, said arm having a triangular shape or A-shape, with its base at the bow of the ship, engaging the weight (10,23) from a point past the weight and with the centre of gravity in the central plane of the arm.

4 Claims, 3 Drawing Sheets

MOORING DEVICE

Invention relates to a mooring device, comprising a mooring body which is fixed relative to the bottom of the water, such as a buoy, a tower or a column with floating power swivellably connected to a bottom anchor, a floating structure such as a ship, a rigid arm between body and ship, said arm being connected by one end so that is pivots about at least a horizontal axis, and being suspended by the other end from a tensionable connecting element and acting via a force-transmitting element on a swivellably suspended weight, while the rigid arm acts on the weight from a point which is situated past the weight, viewed from the other end of the arm.

Such a mooring device is known from European Patent Application No. 0,188,840.

In this known mooring device the rigid arm is fastened by means of a horizontal hinge to the bow of the ship, and the mooring device formed by a column has on either side of its vertical centre line two weights which are swivellably suspended from the column. The end of the rigid arm or arms, which run from the bow of the ship to the tower, are also suspended via a tensionable connecting element from the tower, at the same place as that where the weights are suspended, and said end is at a distance from the weight and acts on the weight via a connecting element which can transmit pressure forces on the weight. Since the rigid arm no longer acts directly on the weight, as known previously from, for example, British Pat. No. 2,019,800, but acts thereon from a distance, this ensures that the curve giving the relationship between the displacement of the ship relative to the tower and the forces thereby occurring can be such that in at least the important region of movements of the ship away from and towards the tower it shows a levelling-off or less steep increase in the force. In other words, through this different manner in which the rigid arm acts on the weight, it is possible to avoid a situation where with increasing displacement the spring formed by this system rapidly becomes stiff, and what is actually achieved is that this spring can be given a characteristic which permits a less rapid increase in the stiffness and even a temporary sagging of the spring.

In the known mooring device, in order to obtain sufficient freedom of movement of the ship relative to the tower, it is necessary for the connecting element by means of which the weight and the connecting element by means of which the rigid arm is suspended from the tower to be of great length. The tower itself must therefore also be high. Another important consideration here is that the conduits to be conveyed via the arm, running from the tower to the ship, must permit the movements. The conduits must therefore be guided from the top end of the tower to the arm and to the ship and, since it must be possible to inspect these conduits, a relatively high structure resulted with connecting elements of large dimensions and with the appropriate heavy weights being necessary to permit the production of the required restoring force at the relevant great length of the connecting elements.

The object of the invention is then to produce a mooring device with which it is possible to limit the dimensions, in particular in the vertical direction, and/or the mass of the weight(s).

This object is achieved according to the invention in that the horizontal hinge of the rigid arm is located at the body, the rigid arm is essentially a triangular frame or A-frame with the base located at the bow of the ship, and the centre of gravity of the weight is in the centre part face of the arm. As will yet be shown with reference to the examples, it is possible with these measures, and using the principle known from European Application No. 0,188,840, to make the connecting elements of a lower length in the vertical direction and/or for the weight to have less mass and to have a spring characteristic which is either equal to that of a mooring device in which the rigid arms acts directly on the weight, or to have a spring characteristic which remains the same or decreases. The triangular or A-shaped frame permits a flexible suspension at the bow of the ship. This is also promoted through the fact that on the basis of the calculation principle known from European Application No. 0,188,840 the same spring characteristic can be produced with a lower weight and/or a shorter length of the connecting elements. At the bow of the ship the space is limited. Conflict between weights, connecting elements, rigid arm and the like and the ship must be avoided. The limitations of weight or connecting element make this possible, for it is now possible with a shorter length of connecting elements to create a suspension above the bow of the ship without needing to have too high a supporting structure for this, or the bow can be exposed to less stress through the fact that the weight suspended from it can be lower. For the ship, a scrapped tanker is generally used, and it is not built for carrying the weight needed for mooring systems of the type described in the preamble to produce a restoring force.

The invention is thus essentially based on a new idea of the principle which was already published in European Patent Application No. 0,188,840.

A further characteristic and improvement of the invention is that the suspension point of the weight can be at a distance from the suspension point of the connecting elements of the ends of the arms. By not making these two points coincide, but placing them apart, preferably not just next to each other but also one above the other, one creates different lever ratios relative to the suspension points, and thus a further influencing of the spring characteristic.

It is also possible according to the invention to provide the ends of the rigid arm with additional weights, so that the common centre of gravity goes at an intermediate point.

The invention will now be explained in greater detail with reference to the drawings.

Figure 1:
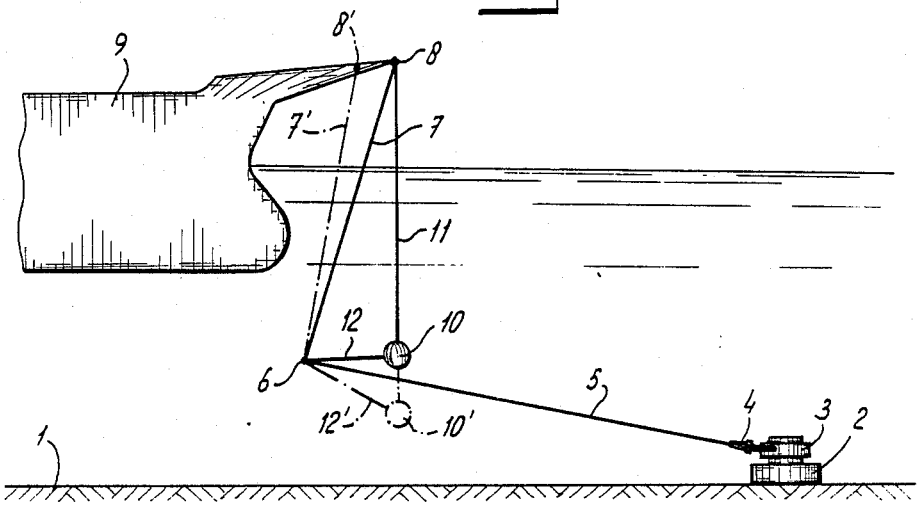
FIG. 1 shows schematically an embodiment of the device according to the invention, this schematic illustration also showing slight variants.

FIG. 1 shows a body 2 positioned on the seabed 1, which is provided with a rotary ring 3, to which a rigid arm 5 is connected by means of a hinge 4. This hinge 4 has a horizontal cross pin on a pin in line with the arm 5. This rigid arm 5 can be in the form of an A-frame, but it can also be in any other suitable form. The ends 6 of the arm 5 are suspended at 8 from the bow of a tanker 9 by means of the connecting elements 7.

The weight 10 is also suspended at 8 from the bow of the tanker by means of the connecting element 11.

A compression-resistant connecting element 12 is provided between the weight 10 and the end of the arm 5. The triangle formed by the connecting elements 7 and 11 and the compression-resistant element 12 is essentially a rigid triangle, even if the connecting elements 7 and 11 consist of cables or chains.

If the tanker 9 moves to the left in FIG. 1, thus away from the anchor 2, the restoring component derived from the weight is formed or increased.

The connecting element 7 can also be disposed on a different place on the bow of the tanker, as indicated by the dotted line 7' towards the point 8'.

The weight 10 can be in a different place from that shown, for example as indicated by the dotted line 10', in which case the compression-resistant connection runs as indicated by the dotted line 12'.

In the embodiment of FIG. 1 the whole structure is underwater.

Figure 2:
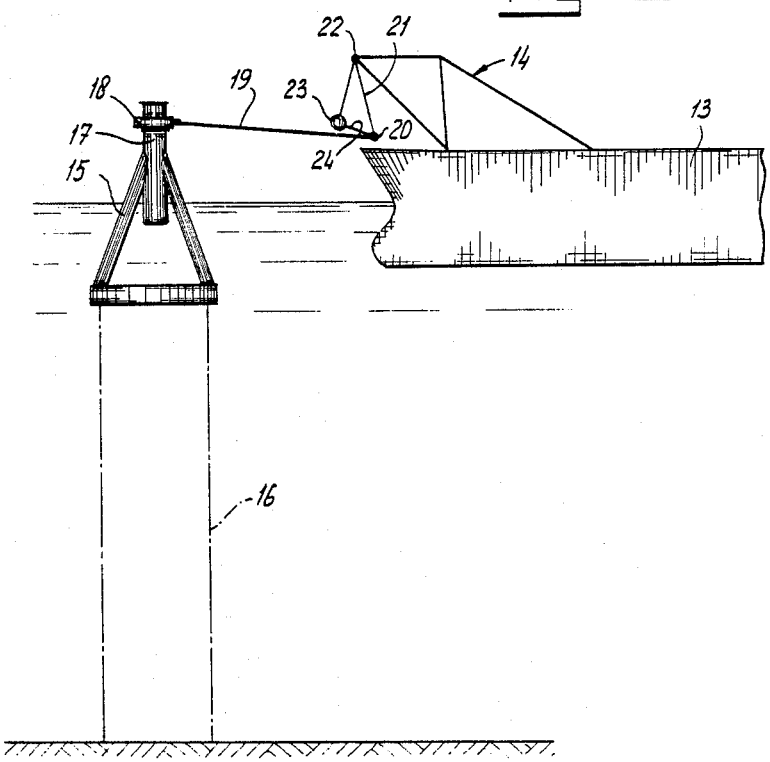
FIG. 2 shows another embodiment.

FIG. 2 shows an embodiment in which the tanker 13 is provided with a supporting structure 14 projecting above the bow.

The body fixed relative to the seabed comprises a partially immersed floating structure 15, which is fixed by means of tension cables 16 and has a column 17 with rotary ring 18, to which the rigid arm 19 is connected. The end 20 of this rigid arm is suspended at 22 via the connecting element 21 from the bridge structure 14. The same applies to the weight 23, and the compression-resistant connection is indicated at 24.

Figure 3:
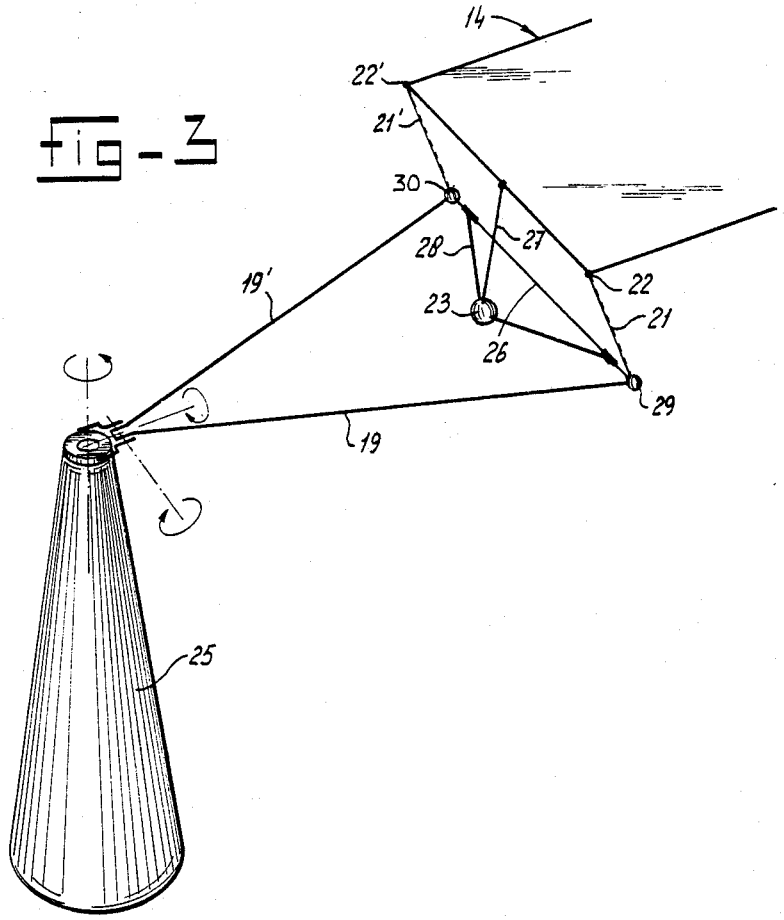
FIG. 3 shows the embodiment of FIG. 2 in prespective.

FIG. 3 shows the embodiment of FIG. 2 in perspective, the body fixed relative to the seabed being indicated in this case in the form of a tower 25.

The rigid arm 19 is in the form of a triangular frame with legs 19, 19' and a base 26. This triangular frame is suspended at 22 and 22' by means of connecting elements 21, 21' from the supporting structure 14. These connecting elements can be formed by chains, cables or bars hingedly connected by their ends.

The weight 23 is suspended from the supporting structure 14 by means of the connecting element 27. The compression-resistant connection is formed by a triangular frame 28 resting on the base 26 of the arm 19, 19'. Additional weights can be positioned at 29 and 30.

Figure 4:
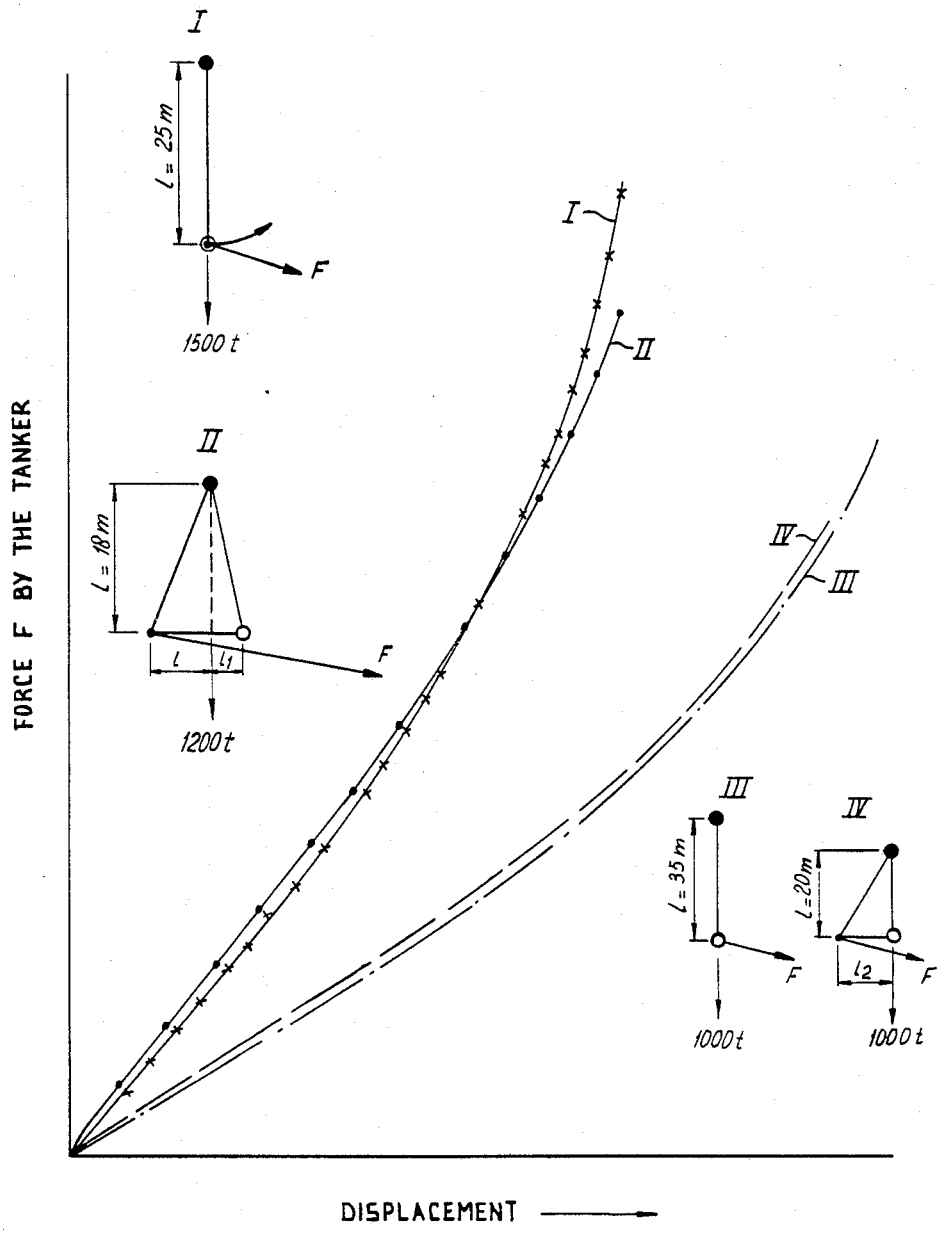
FIG. 4 is a graph to support the effect achieved with the invention.

The graph of FIG. 4 serves to explain the effect of the invention.

The movements which the tanker can carry out relative to the body are indicated on the horizontal axis.

The forces which the tanker can exert are indicated on the vertical axis.

I indicates the curve of tanker forces and displacements with use of a mooring device known from for example, British Patent Specification No. 2,019,800. This curve I is determined here for a weight of 1,500 tons which has to supply the restoring force suspended from a connecting element having a length of 25 meters.

Curve II with accompanying graph II indicates how in the embodiment of, for example, FIG. 1 and with a lengths of 18 meters and a weight of 1,200 tons a curve which is practically equal to that of graph I is produced.

It is therefore possible with less height and less weight to obtain precisely the same spring characteristic. Of course, it is then also possible to obtain a differing characteristic.

Curve III indicates the course of the tanker forces relative to the displacements for a length of 35 meters and a weight of 1,000 tons when the mooring device known per se is used.

Curve IV indicates the situation for a length of 20 meters, a lateral weight displacement of 10 meters, and also at a weight of 1,000 tons.

It can be seen that curve IV runs virtually the same as curve III.

Of course, the lengths 1, 11 and 12 are important for obtaining the correct curve.

With the invention, it is, of course, possible to make the curve 4 such that with increased displacement it flattens off and deviates from curve III.

We claim:

1. Mooring device comprising a mooring body which is fixed relative to the bottom of the body of water, a floating structure, a rigid arm of substantially triangular shape between the mooring body and the floating structure, said arm having a narrow end and a wider base opposite said narrow end, said narrow end being connected to the mooring body by means of at least a horizontal pivot, tension-resistant connecting elements by which said base is suspended from the floating structure, a weight suspended from the floating structure by means of a tension-resistant connecting element, and a pressure-resistant connecting member between the weight and the connections of the base of the rigid arm with the tension-resistant connecting elements suspending said rigid arm from the floating structure, the weight being located in the vertical central plane of the arm, said weight being positioned between the base and the narrow end of the arm.

2. Mooring device as claimed in claim 1, wherein the tension-resitant connecting element carrying the weight and the tension-resistant connecting elements carrying the base of the rigid arm are connected to the floating structure at points spaced apart in a direction away from the mooring body.

3. Mooring device as claimed in claim 2, wherein the point at which said tension-resistant connecting element carrying the weight connected to the floating structure is closer to the mooring body than are the points at which the tension-resistant connecting elements carrying the base of the arm are connected to the floating structure.

4. Mooring device as claimed in claim 1, wherein said base of the rigid arm is provided with additional weights.

* * * * *